United States Patent [19]

Affolter

[11] Patent Number: 5,033,035

[45] Date of Patent: Jul. 16, 1991

[54] WATERTIGHT WATCH

[75] Inventor: Walter Affolter, Zurich, Switzerland

[73] Assignee: Mondaine Watch Ltd., Zurich, Switzerland

[21] Appl. No.: 580,119

[22] Filed: Sep. 10, 1990

[30] Foreign Application Priority Data

Sep. 27, 1989 [CH] Switzerland ..... 3507/89

[51] Int. Cl.[5] ..... G04B 37/00; G04B 39/00

[52] U.S. Cl. ..... 368/294; 368/309; 368/281; 368/282

[58] Field of Search ..... 368/276, 282, 291, 292, 368/293, 295–298, 290, 300, 309, 316

[56] References Cited

U.S. PATENT DOCUMENTS

| | | | |
|---|---|---|---|
| Re. 32,617 | 3/1988 | Gogniat | 368/292 |
| 3,755,017 | 9/1973 | Genta | 368/292 |
| 4,075,828 | 2/1978 | Klingenberg | 368/292 |
| 4,390,288 | 6/1983 | Arnoux | 368/276 |
| 4,440,505 | 4/1984 | Gogniat | 368/292 |
| 4,696,577 | 9/1987 | Muller et al. | 368/276 |

*Primary Examiner*—Bernard Roskoski

*Attorney, Agent, or Firm*—Kane Dalsimer Sullivan Kurucz Levy Eisele and Richard

[57] ABSTRACT

The watch has a housing, composed of a metal center part (1) having a molded-on glass collar (1*a*), a watch glass (2), over whose rim (2*a*) the glass collar engages, and a metal base (3) fixed to the center part by screws (8). A movement retaining ring (6) made from plastic is inserted in the center part (1). A first seal (4) lies between the movement retaining ring (6) and the rim (2*a*) of the watch glass (2) and a second seal (5) between the movement retaining ring (6) and the base (3). The screws (8), which pass through apertures (9) in the edge region (3*a*) of the base (3) and are screwed into axial threaded openings (10) in the center part (1) not only serve to secure the base but also simultaneously compress both seals (4, 5) when tightened.

14 Claims, 2 Drawing Sheets

WATERTIGHT WATCH

FIELD OF THE INVENTION

The present invention relates to a watertight watch having a housing, composed of a center part having a molded-on glass collar, a watch glass inserted with the interposition of a first seal, over the rim of which watch glass the glass collar engages, and a metal base secured to the center part with the interposition of a second seal, and having means for axially compressing the seals.

PRIOR ART

Such a watch is known, for example, from CH-A-5 208/71. In this watch, an upper seal lies between the glass collar and the upper side of the watch glass rim, and a lower seal between the base and a radially inwardly projecting shoulder of the housing center part. In order to compress the two seals, two separate devices are necessary. In this arrangement, the base is axially pressed against the lower seal by the device serving to secure it, whereas a slotted, elastic metal ring serves to compress the upper seal and is retained in an inner annular groove of the housing center part, a vertical spacer ring arranged between watch glass and face bearing on said metal ring. In the assembled state of the watch, this metal ring is axially bent in a manner such that it presses the vertical spacer ring against the underside of the watch glass rim and thereby compresses the upper seal.

SUMMARY OF THE INVENTION

The object of the present invention is to simplify the construction and the assembly of a watch of the type described, and to design the means for axially compressing the seals in such a manner that particularly reliable tightness is guaranteed.

This object is achieved, according to the invention, in that the base engages with its edge region over the underside of the center part and bears on this underside thereof, in that a movement retaining ring made from plastic is inserted in the center part, in that the first seal (4) is clamped between this movement retaining ring and the rim of the watch glass and the second seal (5) is clamped between this movement retaining ring and the base, and in that the means for the axial compression are composed of screws, preferably countersunk screws, inserted from below which pass through apertures in the edge region of the base and are screwed into axial threaded openings provided in the center part (1), as a result of which these screws simultaneously secure the base to the center part.

The technical advantages of the watch according to the invention reside in the fact that the screws firstly secure the base to the center part and secondly simultaneously compress both seals, it being possible to achieve a correspondingly strong compression by a correspondingly strong tightening of the screws, and it also being possible to readjust the screws if required to improve the seal.

Since the movement retaining ring is composed of plastic and the base, preferably together with the center part with molded-on glass collar, is manufactured from metal, the two seals are advantageously clamped between a metal part and the plastic material of the movement retaining ring, which is generally slightly yielding, as a result of which the sealing becomes particularly reliable.

The housing of the watch according to the invention can be a circular or oval housing or a housing of any desired shape, in particular a rectangular housing. Advantageously, the base is curved concavely downwards, and this curved base is slightly prestressed elastically by tightening the screws, this tending to reduce its curvature, which it exhibits in the unstressed state. In this case, the elastic restoring force of the prestressed metal base also makes a further contribution to the secure clamping of the seals.

Advantageous further embodiments of the watch according to the invention are apparent from the dependent claims.

BRIEF DESCRIPTION OF THE DRAWINGS

The invention is explained in greater detail with reference to the drawings in connection with illustrative embodiments of wristwatches. In the drawings.

DESCRIPTION OF THE PREFERRED EMBODIMENTS

Figure 1:
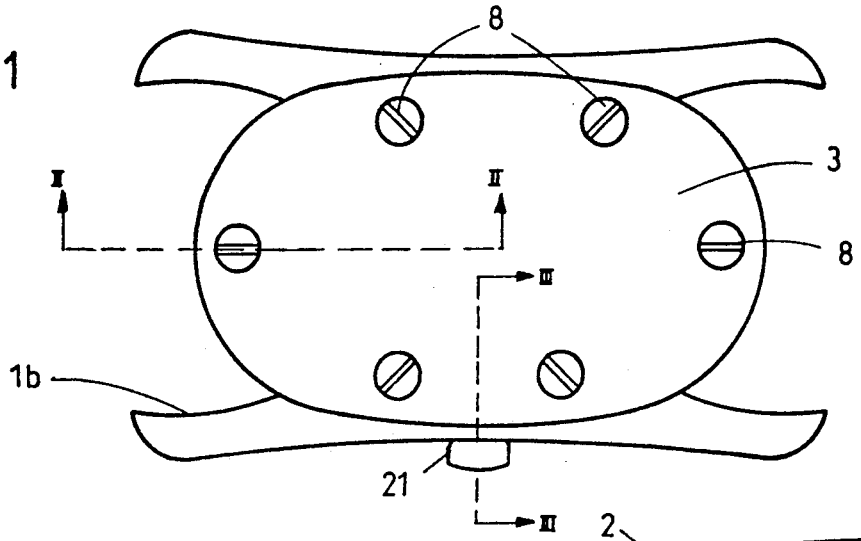
FIG. 1 shows a plan view of the base of a first embodiment.
Figure 2:
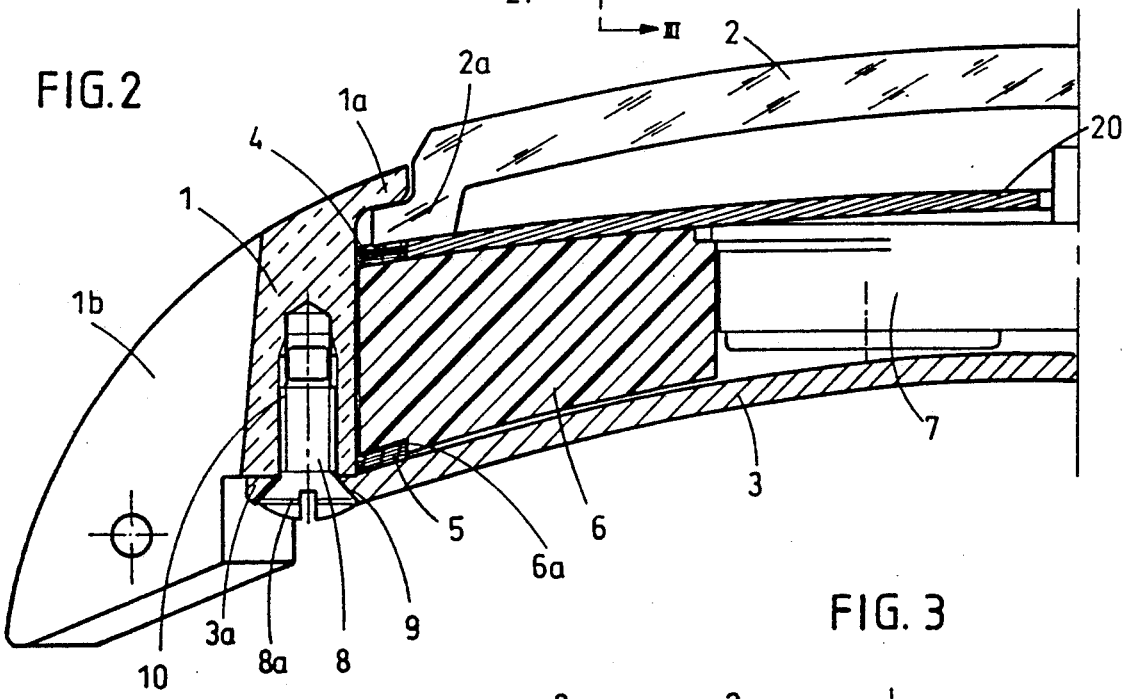
FIG. 2 shows a section on an enlarged scale along the line II—II in FIG. 1, in other words through the 12 o'clock symbol, only one half of the watch being shown.
Figure 3:
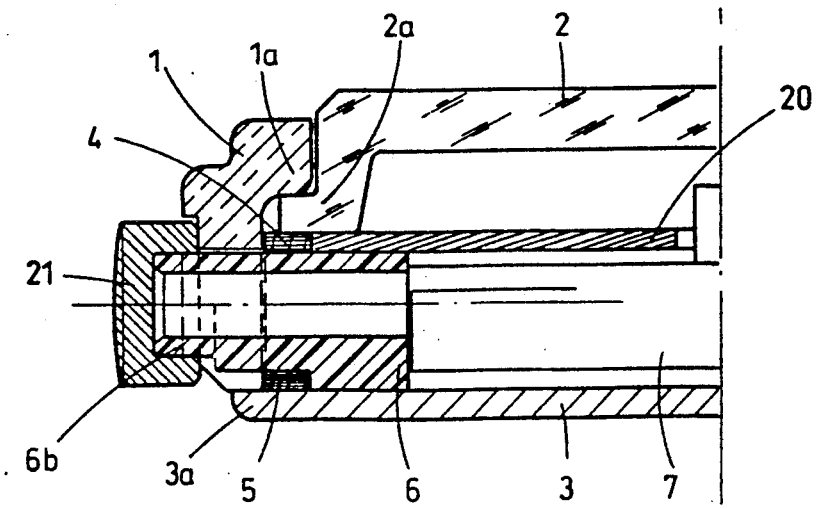
FIG. 3 shows a section along the line III—III in FIG. 1, in other words through the 3 o'clock symbol.

The wristwatch shown in FIGS. 1 to 3 has an oval housing which is composed of a metal center part 1 having a molded-on glass collar 1*a*, a pot-shaped watch glass 2 having a radially outward pointing rim 2*a* over which the glass collar 1*a* engages, and of a metal base 3 secured to the center part 1 by means of screws 8. In this center part 1 is inserted a movement retaining ring 6 which supports the watch movement 7 and, in the preferred example considered, is composed of plastic. On this movement retaining ring 6 rests the edge of the face 20, which is additionally supported by the watch movement 7.

The tightness of the watch is achieved with the aid of two seals 4 and 5 in the form of sealing rings. The upper seal 4 surrounds the face 20 and lies between the movement retaining ring 6 and the underside of the rim 2*a* of the watch glass 2, which simultaneously also rests on the edge of the face 20 and retains the latter. The lower seal 5 lies between the base 3 and the movement retaining ring 6, and does so in an annular groove 6*a* provided on the underside of this movement retaining ring 6, from which groove said seal 5 projects somewhat. Diametrally opposite strap attachments 1*b* are molded onto the center part 1 (FIG. 2). The pipe 6*b* for the passage of the hand adjustment shaft is molded onto the movement retaining ring 6 (FIG. 3), passes through a corresponding aperture 1*c* in the center part, and bears at its outer edge the winder 21.

As can be seen in the sectional representation according to FIG. 2, the base 3 is curved concavely and cylindrically, or at least approximately cylindrically, downwards, as a result of which it is better matched to the curvature of the wrist. The movement retaining ring 6 is adapted on its underside to the curvature of the base 3, and its upper side and the face 11 are, to a lesser degree, convexly curved upwards.

The base 3 engages with its edge region 3*a* over the underside of the center part 1 and bears on this underside. A plurality of screws 8, distributed over the edge region 3*a* of the base, pass through apertures 9 provided in this edge region and are screwed into axial threaded openings 10 in the center part 1. The screws 8 are countersunk screws, the conical heads 8*a* whereof are countersunk into the apertures 9 in the base rim 3*a* which are of correspondingly conical design. These screws 8 serve simultaneously both to secure the base 3 and to compress the two seals 4 and 5 axially, and a correspondingly reliable tightness can be achieved by a correspondingly strong tightening of the screws. In addition, after prolonged wearing of the watch, the screws 8 can be readjusted if required. The compressive action on the seals 4 and 5 is further intensified by the fact that the curved base 3 is elastically prestressed during tightening of the screws 8, this tending to reduce its concavity, which it possesses in the unstressed state. As a result, the elastic restoring force of the metal base 3 also contributes to the compressive force.

Figure 4:
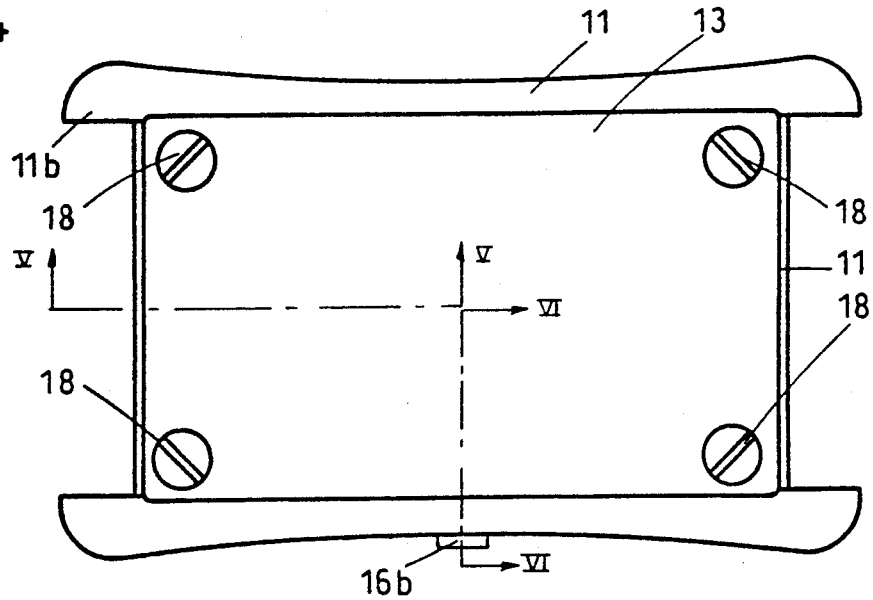
FIG. 4 shows a plan view of the base of a second embodiment.
Figure 5:
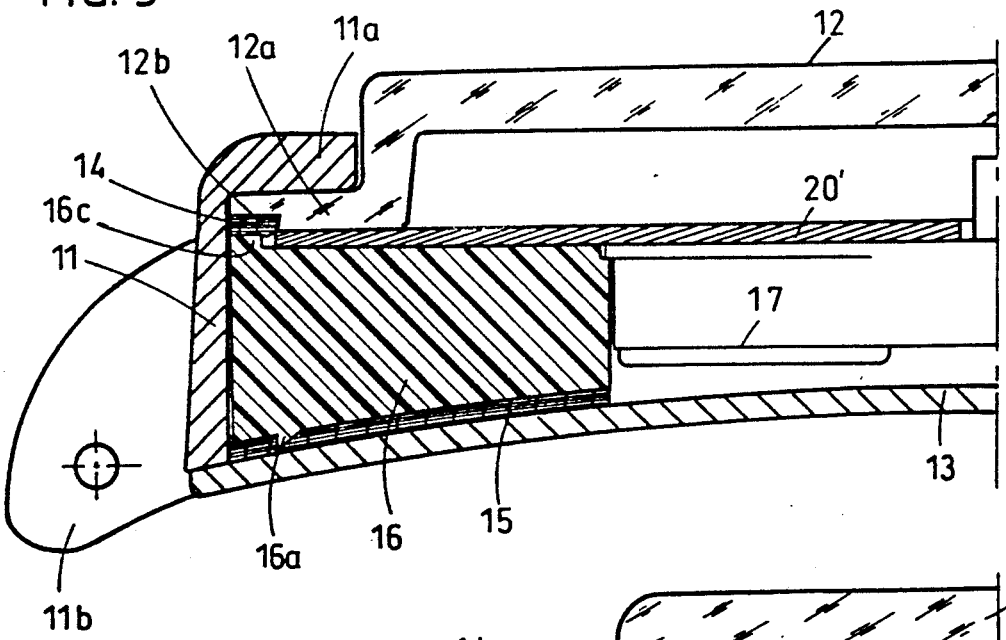
FIG. 5 shows a section on an enlarged scale along the line V—V in FIG. 4.
Figure 6:
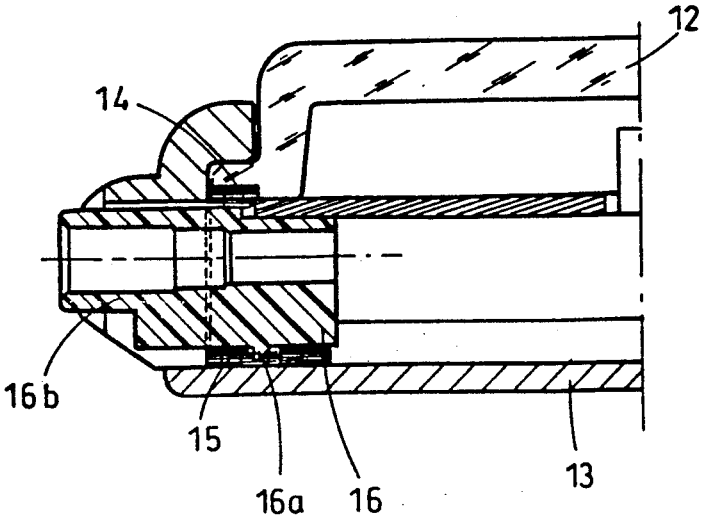
FIG. 6 shows a section along the line VI—VI in FIG. 4.

The second illustrative embodiment of a wristwatch according to the invention, shown in FIGS. 4 to 6, has a rectangular housing which in turn is composed of the center part 11 having a molded-on glass collar 11*a* and molded-on strap attachments 11*b*, the pot-shaped watch glass 12 and the screwed-on base 13, which, as in the first example, is curved towards the strap attachments 11*b*. The movement retaining ring 16 for the watch movement 17 inserted in the center part is composed of plastic, and the pipe 16*b* for the passage of the hand adjustment shaft is again molded on to this center part 16.

In this example, the upper seal 14 is inserted in an annular groove 12*b* provided on the underside of the watch glass rim 12*a*, projects somewhat therefrom, and bears with its radially outward lying region on a corresponding annular shoulder 16*c* of the movement retaining ring 16, whereas it presses with its radially inward lying region on the edge of the flat face 20', which, at the center, bears on the watch movement 17 and with its edge region on the movement retaining ring 16.

In this illustrative embodiment, the lower seal 15 has the shape of a perforated disk, whose rectangular outer periphery is matched to that of the movement retaining ring 16 and whose round central opening corresponds to the dimension of the watch movement 17 and lies under the latter. This shaped seal in the shape of a perforated disk of varying width thus extends radially virtually over the whole radial dimension of the movement retaining ring 16. In order to obtain a good positioning of this seal 15, at least one projection 16*a* is molded onto the underside of the movement retaining ring 16 and presses into the seal 15. In the example considered, the projection 16*a* is composed of an annular rib which tapers sharply in cross-section. This design and arrangement of the lower seal 15 guarantees a particularly reliable tightness and, at the same time, a particularly secure seating of the movement retaining ring 16.

According to FIG. 4, four screws 18 are provided at the corners of the base 13 to secure the latter and to compress the seals 14 and 15.

The housing of the watch according to the invention may be a circular casing or a casing of any desired design, since neither the securing of the base to the center part by means of the screws nor the reliable compression of the two sealing rings, which are corresponding shaped seals, are dependent on the design of the housing. In general, a sealing ring of any desired width, even of varying width, can be used as the lower seal and can extend radially over a large part of the radial dimension of the movement retaining ring, especially over at least half of its radial dimension. It is not necessary for the base to be curved, but instead the watch according to the invention can also be provided with a flat base.

The invention is not restricted to the illustrative embodiments described and shown, but allows multiple variations in respect of the embodiment of its individual parts.

I claim:

1. A watertight watch comprised of a housing, composed of a center part (1) which possesses a molded-on glass collar (1*a*), a watch glass (2) having a rim (2*a*), a first seal (4) being engaged with the rim (2*a*) adjacent to the watch glass and engaging the glass collar (1*a*), and a metal base (3) secured to the center part (1) with the inter-position of a second seal (5), and having means for axially compressing the first and second seals (4, 5), wherein the base (3) further possesses an edge region (3*a*), the base (3) being engaged with the edge region (3*a*) over the underside of the center part (1) and bearing on the underside, wherein a movement retaining ring (6) made from plastic is inserted in the center part (1), wherein the first seal (4) is clamped between the movement retaining ring (6) and the rim (2*a*) of the watch glass and the second seal (5) is clamped between the movement retaining ring (6) and the base (3) and wherein the means for the axial compression comprise screws inserted from below the base which pass through apertures (9) in the edge region (3*a*) of the base (3) and are screwed into axial threaded openings (10) provided in the center part (1) resulting in the simultaneous securing of the base (3) to the center part (1), and wherein the base (3) is concavely curved downwards and wherein this curved base (3) is elastically prestressed by tightening the screws (8), this tending to reduce its curvature which it exhibits in the unstressed state.

2. The watch as claimed in claim 1, wherein the screws (8) are countersunk screws.

3. The watch as claimed in claim 1, wherein the center part (1) having a molded-on glass collar (1*a*) is composed of metal.

4. The watch as claimed in claim 1, wherein the movement retaining ring (6) is matched on its underside to the curvature of the base (3).

5. The watch as set forth in claim 1, wherein the first seal (4) surrounds the outer periphery of the face (20), the first seal and face resting on the watch movement (7) or on the movement retaining ring (6), and wherein the rim (2*a*) of the watch glass (2) rests on the rim of the face.

6. The watch as claimed in claim 5, wherein the first seal (14) is arranged in a groove (12*b*) provided on the underside of the watch glass rim (12*a*).

7. The watch as claimed in claim 1, wherein the upper side of the movement retaining ring (6) and the face (20) are curved convexly upwards.

8. The watch as claimed in claim 1, wherein the second seal (5) lies in an annular groove (6*a*) of the movement retaining ring (6).

9. The watch as claimed in claim 1, wherein the second seal (15) is designed in the manner of a broad perforated disk and extends radially over at least a large part of the radial dimension of the movement retaining ring (16).

10. The watch as claimed in claim 9, wherein said movement retaining ring is provided on its underside with at least one projection (16*a*) pressing into the second seal (15).

11. The watch as claimed in claim 1, wherein a pipe (6*b*) for the passage of the hand adjustment shaft is molded onto the movement retaining ring (6).

12. The watch as claimed in claim 1, wherein the housing is circular.

13. The watch as claimed in claim 1, wherein the housing is a shaped housing, for example of oval or rectangular design.

14. The watch as set forth in claim 10 wherein at least one projection is in the form of an annular rib.

* * * * *